US007293771B1

(12) United States Patent
Montgomery

(10) Patent No.: US 7,293,771 B1
(45) Date of Patent: Nov. 13, 2007

(54) BASKETBALL BOARD GAME

(75) Inventor: Michael B. Montgomery, Madison, IN (US)

(73) Assignee: Royer Corporation, Madison, IN (US)

( * ) Notice: Subject to any disclaimer, the term of this patent is extended or adjusted under 35 U.S.C. 154(b) by 0 days.

(21) Appl. No.: 10/937,513

(22) Filed: Sep. 9, 2004

Related U.S. Application Data

(60) Provisional application No. 60/551,399, filed on Mar. 9, 2004.

(51) Int. Cl.
*A63F 3/00* (2006.01)

(52) U.S. Cl. ..... 273/244; 273/259; 273/277

(58) Field of Classification Search ..... 273/244, 273/244.1, 247, 259, 277, 298
See application file for complete search history.

(56) References Cited

U.S. PATENT DOCUMENTS 1,520,010 A * 12/1924 Clark ..... 273/247
3,545,763 A * 12/1970 Seitz ..... 273/244
3,685,170 A 8/1972 Fairleigh
3,853,322 A * 12/1974 Mercer ..... 273/244
3,941,386 A * 3/1976 Nelson ..... 273/259
4,186,928 A 2/1980 Hunt, Jr.
4,346,897 A * 8/1982 Sisak ..... 273/271
4,371,168 A 2/1983 Dupuis
4,452,453 A 6/1984 Daley et al.
5,123,653 A 6/1992 Murphy et al.
5,472,191 A 12/1995 Hendricks
5,749,581 A 5/1998 Poisson
6,142,473 A 11/2000 Bryant
6,213,468 B1 4/2001 Van Dalen et al.
6,464,507 B1 * 10/2002 Bailey ..... 434/247
6,530,571 B1 3/2003 McWilliams
6,631,905 B1 10/2003 Slade

* cited by examiner

*Primary Examiner*—Vishu K. Mendiratta
(74) *Attorney, Agent, or Firm*—Theresa Fritz Camoriano; Camoriano and Associates

(57) ABSTRACT

A board game combining an element of chance (via a random event generator, such as a die) with strategy to decide the outcome of the game. Game pieces are moved along a numerically sequenced series alternating in a pattern from inside a dividing line to outside of this same line and back again until a game piece reaches the free-throw line, at which time it may be "shot" in order to score, provided that the required character is generated by the random event generator. Whether a game piece may come into the game and whether it may advance along the sequential series depends on the random event generator. However, which game piece to play, assuming a valid move can be made, is up to the player(s) of the team, and the strategy followed by the team player(s) can have a major impact in the outcome of the game.

8 Claims, 2 Drawing Sheets

BASKETBALL BOARD GAME

BACKGROUND OF THE INVENTION

This application claims priority from U.S. Provisional Application Ser. No. 60/551,399 filed Mar. 9, 2004, which is hereby incorporated by reference.

The present invention relates to a board game. More particularly, it relates to a basketball board game which uses both chance (i.e. rolling of a die) and strategy (i.e. choice of which game piece to move) to determine the outcome of the game.

SUMMARY OF THE INVENTION

The present invention provides a board and a plurality of game pieces. Two or more players may participate in a game, with each game having two opposing teams on the board. Each team plays its own game pieces in its half of the "court" (its half of the board). Each team also has its own random event generator. In a preferred embodiment, the random event generator is a die which, when cast, may come up showing either a:

letter "A" (which allows a game piece to enter the game), or the numbers:

"1" (allows the team to score if a game piece is on the free-throw line),

"2" (allows a game piece to advance from inside the 3-point line to outside the 3-point line), or "3" (allows a game piece to advance from outside the 3-point line to inside the 3-point line).

The game pieces advance sequentially through a numbered sequence of positions on the court, from the number 1 (corresponding to the location of the game piece where it is first put into play by rolling an "A" in the die), through the number 16 (corresponding to the location of the game piece where it may score from the free-throw line by rolling a "1" in the die and then is taken out of the game). In order to advance along the sequence of positions, the game pieces alternate from a location on the first side of the dividing line (the 3-point line) to a location on the second side of the dividing line, back to the first side, and so on. They do so by rolling a "2" to move from the inside to the outside of the dividing line, and by rolling a "3" to move from the outside to the inside of the dividing line.

Also in the preferred embodiment, a move must be taken by the team rolling the die, if a game piece can be moved. If a game piece lands in a spot already taken by another game piece, one of the two game pieces is returned to the "start" rack on the sidelines to start the process all over again. Each team may decide which one of its game pieces to move with each roll of the die in order to improve its chances of winning the game. Each team takes turns rolling its respective die. In a first preferred embodiment, once a team has rolled its die and made its move in accordance with that roll, the play shifts to the other team. In an alternate embodiment of the game, a team may continue to roll the die as long as it can move a game piece with each roll of the die. The first team to "shoot" all its game pieces by having traversed all the positions in its half of the court in the correct sequence wins the game.

In one embodiment of the board game, the game pieces are magnetic (or have magnetic bases) and the board itself is paramagnetic such that the game pieces may be placed on the board and will remain where placed even when the board is jostled around. In a second embodiment of the board game, the game pieces have pegs projecting from their respective bases, and the board itself has recesses to accommodate the pegs in order to place and releasably secure the game pieces to the board. Of course, the means for retaining the game pieces on the board do not have to be present in order for the game to be played, and the pieces may just rest on the board.

DESCRIPTION OF THE PREFERRED EMBODIMENTS

Figure 1:
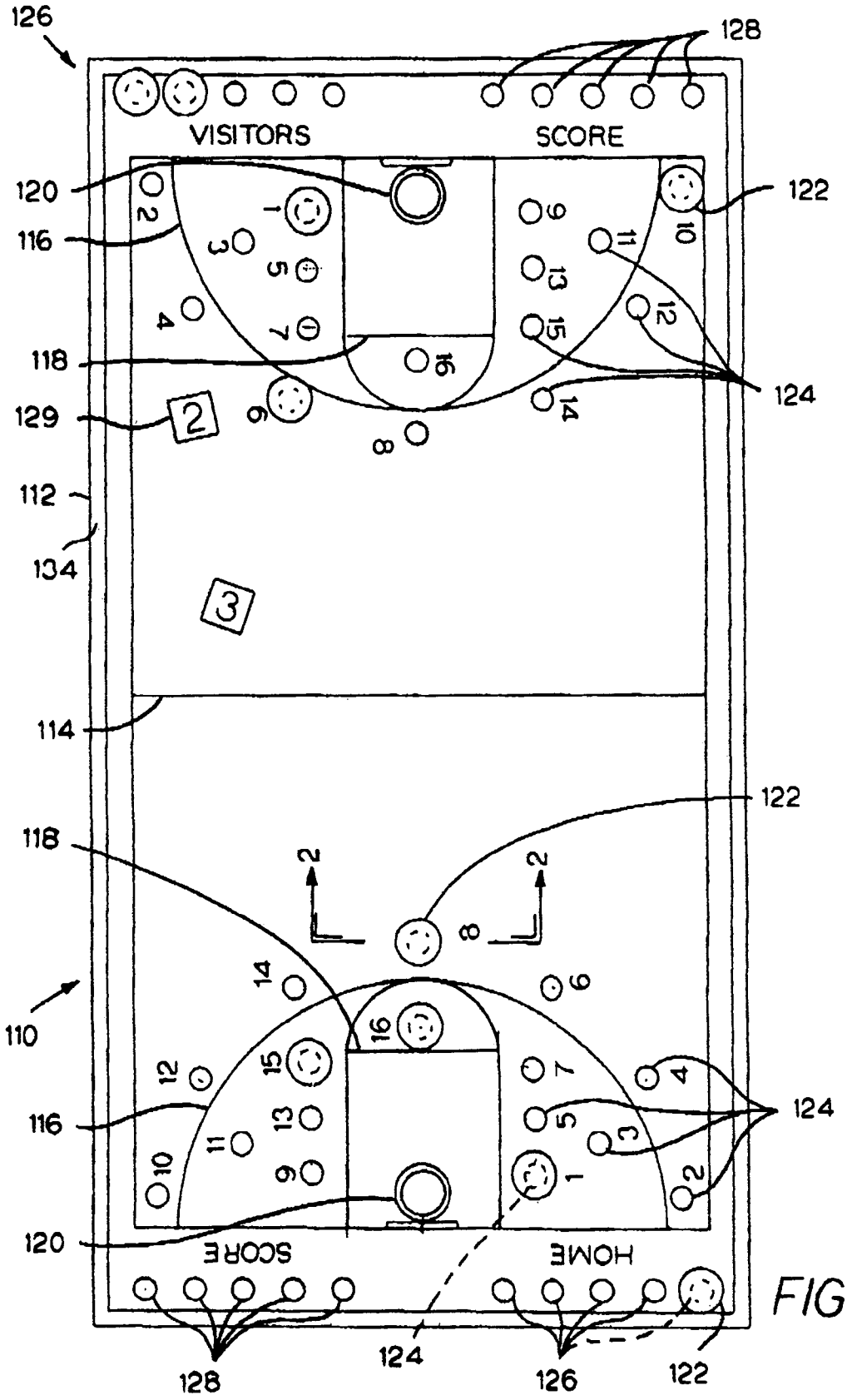
FIG. 1 is a plan view of a board game made in accordance with the present invention.
Figure 2:
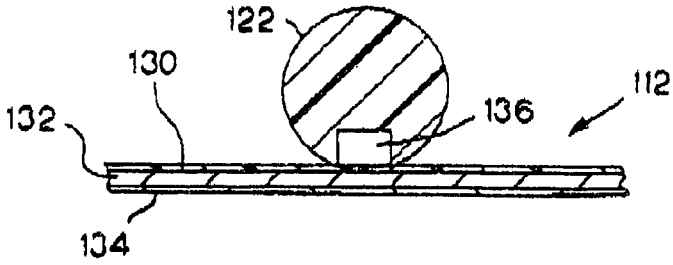
FIG. 2 is a broken-away section view along line 2-2 through the board of FIG. 1.
Figure 4:
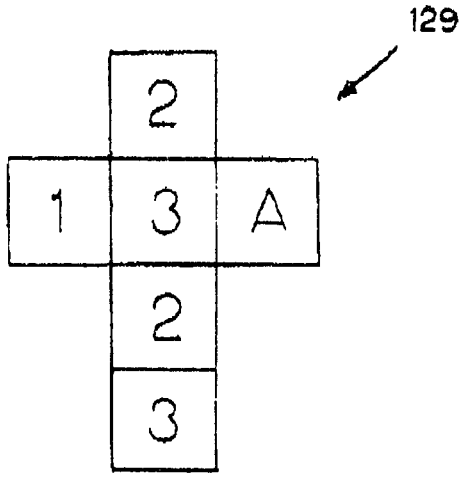
FIG. 4 is a plan view of one of the pair of dice of FIG. 1 unfolded, showing how the dice are numbered.

FIGS. 1 and 2 show a first embodiment of a board game 110 made in accordance with the present invention. The game 110 includes a rectangular board 112, which folds onto itself along a centerline 114. The top surface of the board 112 depicts a basketball court, with each end of the court including a half-circle dividing line 116 (also designated the 3-point line 116) and a free-throw line 118 adjacent its respective goal 120. At each end of the board are five game pieces 122 shaped like basketballs, but having flat bottoms, and a game piece shaped like a goal with a basket 120. Also at each end of the court are several numbered spots 124, numbered consecutively from 1 to 16. On the game board 112 at each end outside of the court are five aligned spots 126 labeled "home" or "visitor" (also referred to in this specification as the "start" rack 126) and five aligned spots 128 labeled "score". The numbered spots 124 on the court alternate from lying inside the 3-point dividing line 116 to lying outside the 3-point line 116, with the numbered spot 124 labeled #1 being inside the dividing line, #2 outside, #3 inside, #4 outside, and so forth. The free-throw spot, labeled #16, is at the free-throw line, which is inside the 3-point dividing line 116. There is also a pair of dice 129, one die for each side or team. It is preferred that the dice be of different colors. As shown in FIG. 4, in this embodiment, each die 129 has two sides (or faces) with the number "2", two sides with the number "3", one side with the number "1", and one side with the letter "A".

As seen in FIG. 2, the board 112 is made of a top sheet 130, made of paper, on which the basketball court is printed, a paramagnetic sheet 132, containing a ferrous metal, and a fiber-reinforced bottom sheet 134. The bottom sheet 134 wraps around the sides and top of the board 112 at the edges to make a kind of hem. At the fold line 114, the paramagnetic sheet 132 is absent, so the board is thinner along that line 114, making it easier to fold there. Each of the game pieces 122 and the goal 120 has a magnet 136 embedded in a recess in its bottom surface, as shown in FIG. 2. The magnets 136 are attracted to the paramagnetic layer 132 in the board 112 containing a ferrous metal, which holds the pieces 122, 120 in place on the board 112. This means that the game can even be played in the car while traveling.

At the beginning of the game, one team takes the "home" side, and the other takes the "visitor" side. Each team takes one die and places its five basketballs 122 on the five spots 126 in its respective "start" rack, which is labeled "home" or "visitor", depending upon which side the team has chosen.

Then, the teams take turns rolling their respective die. To move a ball 122 onto the floor or court, a team must roll an "A" and then place the ball 122 on the spot 124 labeled #1. Then, the team moves the ball 122 from the spot #1 to the other numbered spots 124 in consecutive order by rolling a "3" to move from spots that are outside the 3-point line 116 and rolling a "2" to move from spots that are inside the 3-point line 116. So, for example, in order to move from #1 (inside the 3-point line) to #2, the team must roll a "2". To move from #2 (outside the 3-point line) to #3, the team must roll a "3", and so forth. A team may enter a new ball 122 onto the court each time it rolls an "A", provided there is not a ball 122 in spot #1. Each team must move if a move is available. If a ball 122 lands on a spot 124 already occupied by a ball 122, then one of the balls 122 is returned to the "home" or "visitor" start rack.

For example, with a ball in spot #7 (inside the 3-point line), a ball in spot #6 (outside the 3-point line), and a ball in spot #13 (inside the 3-point line), if the player rolls a "3", he must move the ball from spot #6 to spot #7, bumping the ball from spot #7 back to the start rack. Once a ball 122 gets to spot #16, at the free throw line 118, the player must roll a "1" to get the ball 122 off of the court and into one of the spaces 128 on the score rack. The first team to get all five of its balls 122 around the court and into its score rack 128 wins the game.

Figure 3:
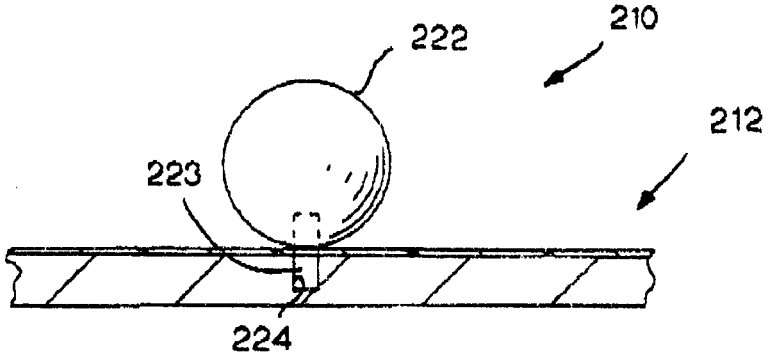
FIG. 3 is a broken-away section view, similar to that of FIG. 2, but for a second embodiment of a board game made in accordance with the present invention.

FIG. 3 shows a second embodiment 210 of a game made in accordance with the present invention. In this case, the game is played the same way as the first embodiment 110, but the game board 212 is a wooden board, approximately one-half inch thick. The start racks, score racks, and spots on the surface of the court are cylindrical recesses 224, in the board 212, and the playing pieces 222 have a projection 223 on their bottom surface, which is received in the cylindrical recesses as the game pieces 222 are moved along the board 212. Of course, the board 212 need not be a wooden board to fulfill its function. It may be made from a plastic block or from a laminate, for instance, with the recesses molded or drilled into the board 212.

While the embodiments described above show examples of a basketball board game, various modifications are possible. For instance, a different type of random event generator other than a die could be used, such as a spinner, or the die could have characters other than letters or numbers (icons, for instance) to indicate the random outcome generated. The sequentially numbered series marked on each end of the court could be a sequentially lettered series (A through P, for instance), or any other type of readily identifiable sequential series, and the length of the sequence may be shorter than or longer than the 16 items depicted in FIG. 1. While it is preferred that each of the sequentially numbered positions in the consecutive alphanumeric sequence alternates sides of the dividing line 116 as shown here, for example, with the number 1 being on a first side of the line, the next consecutive number 2 on the second side, the next consecutive number 3 on the first side, the next consecutive number 4 on the second side, the next consecutive number 5 on the first side, the next consecutive number 6 on the second side, the next consecutive number 7 on the first side, the next consecutive number 8 on the second side, and so forth, some other alternating pattern could be used, such as numbers 1 and 2 being inside the line, number 3 being outside the line, 4 and 5 inside, and so forth. In that case, rolling a first character, such as a 2, allows the player to advance from a position inside the dividing line, and rolling a second character, such as a 3, allows the player to advance from a position outside the dividing line. A variety of sequential patterns can be imagined in addition to the alternating consecutive alphanumeric sequence described above. It will be obvious to those skilled in the art that modifications may be made to the embodiments described above without departing from the scope of the present invention.

What is claimed is:

1. A board game, comprising:

a game board defining a playing area having first and second ends, said first end of said game board defining a first half circle dividing line resembling the three-point line on a standard basketball court; and a plurality of marked locations at said first end comprising a first consecutive sequential series of non-repeating alphanumeric characters;

said first consecutive sequential series forming an alternating pattern in which one location in the consecutive sequential series is on a first side of its respective dividing line; the next location in the consecutive sequential series is on a second side of its respective dividing line; the next location in the consecutive sequential series is on the first side; and the next location in the consecutive sequential series is on the second side, wherein the location on one of the first and second sides of the first half circle dividing line is inside the half circle and the location on the other side of the half circle dividing line is outside the half circle;

said second end of said game board defining a second half circle dividing line resembling the three-point line on a standard basketball court; and a plurality of marked locations at said second end comprising a second consecutive sequential series of non-repeating alphanumeric characters;

said second sequential series forming an alternating pattern in which one location in the consecutive sequential series is on a first side of its respective half circle dividing line; the next location in the consecutive sequential series is on a second side of its respective dividing line; the next location in the consecutive sequential series is on the first side; and the next location in the consecutive sequential series is on the second side, wherein the location on one of the first and second sides of the second half circle dividing line is inside the half circle and the location on the other side of the half circle dividing line is outside the half circle;

a plurality of game pieces; and a random event generator.

2. A board game as recited in claim 1, wherein said random event generator comprises at least one die, wherein said die includes at least a first character and a second character.

3. A board game as recited in claim 1, wherein said board includes a paramagnetic material, and said game pieces each include at least one magnetic base.

4. A board game as recited in claim 1, wherein said board includes a plurality of cylindrical recesses, and each of said game pieces includes at least one projection which can be received in said cylindrical recesses.

5. A board game as recited in claim 1, and further comprising at least one game piece resembling a goal post with a basket and at least one other game piece resembling a basketball.

6. A board game as recited in claim 1, wherein the indicia on the outside of each respective dividing line form an arc which follows the shape of the respective dividing line.

7. A board game as recited in claim 1, wherein said random event generator is a cube with six faces, with the first and second of said six faces bearing the same first unique indicia, the third and fourth of said six faces bearing the same second unique indicia, and the fifth and sixth faces bearing third and fourth unique indicia, respectively.

8. A board game as recited in claim 7, wherein the first unique indicia represent the number 2, and the second unique indicia represent the number 3.

* * * * *